US009694611B2

(12) United States Patent
Anzai et al.

(10) Patent No.: US 9,694,611 B2
(45) Date of Patent: Jul. 4, 2017

(54) LIQUID DISCHARGING APPARATUS AND METHOD OF CLEANING SCALE PORTION

(71) Applicant: Seiko Epson Corporation, Tokyo (JP)

(72) Inventors: Sumito Anzai, Shiojiri (JP); Norihiro Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/171,234

(22) Filed: Jun. 2, 2016

(65) Prior Publication Data

US 2016/0368269 A1 Dec. 22, 2016

(30) Foreign Application Priority Data

Jun. 18, 2015 (JP) ..... 2015-122640

(51) Int. Cl.
*B41J 2/165* (2006.01)
*B41J 19/20* (2006.01)

(52) U.S. Cl.
CPC ..... *B41J 19/207* (2013.01)

(58) Field of Classification Search
None
See application file for complete search history.

(56) References Cited

U.S. PATENT DOCUMENTS

2006/0028660 A1* 2/2006 Lim ..... B41J 29/17 358/1.5

FOREIGN PATENT DOCUMENTS

| | | | |
|---|---|---|---|
| JP | 10-253318 | A | 9/1998 |
| JP | 2006-289771 | A | 10/2006 |
| JP | 2012-210781 | A | 11/2012 |

OTHER PUBLICATIONS

Sakura, Seizo, Image Forming Device, Sep. 17, 2009, Japan, pp. 1-19.*

* cited by examiner

*Primary Examiner* — Matthew Luu
*Assistant Examiner* — Tracey McMillion
(74) *Attorney, Agent, or Firm* — Workman Nydegger

(57) ABSTRACT

A liquid discharging apparatus having a carriage that is capable of moving in a scanning direction and that has a discharging portion capable of discharging a liquid, a scale portion for confirming a position in the scanning direction of the carriage, and a cleaning portion that moves in the scanning direction of the carriage and is capable of cleaning the scale portion by contacting the scale portion. In such an apparatus, the cleaning portion is capable of displacement at a first state where contacting the scale portion and a second state where not contacting the scale portion.

7 Claims, 8 Drawing Sheets

FRONT/REAR OPERATION DIRECTION MOVEMENT
33
C
P, G1
12, 12a
32, 32a
G2
FRONT/REAR OPERATION DIRECTION MOVEMENT
17
16, 16b
16, 16a
32, 32b
B
12, 12b
G2
FRONT/REAR OPERATION DIRECTION MOVEMENT
P, G1
R
A
33
34
33

17
C
B
R
P, G1
B1
G2
A

17
C
B
R
R1
B1
12
R2
A

LIQUID DISCHARGING APPARATUS AND METHOD OF CLEANING SCALE PORTION

BACKGROUND

1. Technical Field

The present invention relates to a liquid discharging apparatus and a method of cleaning a scale portion.

2. Related Art

To date, liquid discharging apparatuses have been used that are provided with a carriage that is capable of moving in the scanning direction and that has a discharging portion capable of discharging a liquid. Such apparatuses are often provided with a scale portion for confirming the position of the carriage so that the liquid can be discharged at desired positions on the media.

For example, JP-A-2006-289771 describes an ink jet recording apparatus (liquid discharging apparatus) provided with a carriage that is capable of moving in the scanning direction and that has a recording head (discharging portion) capable of discharging ink (liquid); an encoder scale (scale portion) for confirming the position of the carriage; and a flexible member (cleaning portion) for removing ink mist that has adhered to the encoder scale.

In recent years, a need has arisen for a liquid discharging apparatus that can discharge a liquid onto various types of media such as, for example, fabric. When fabric is supported by the media supporting portion, unevenness in the fabric tends to become more profound and fluffing and the like is prone to occur. As such, when discharging liquid on fabric, it is common to increase the space between the discharging portion and the fabric. However, the amount of mist produced generally increases as a result of increasing the space. Consequently, mist adheres to the scale portion which may, in some cases, lead to a decline in the confirmation accuracy of the carriage.

For this reason, the ink jet recording apparatus described in JP-A-2006-289771 is provided with a flexible member for removing ink mist that has adhered to the encoder scale. However, the flexible member is in a state of constant contact with the encoder scale and the flexible member causes the encoder scale to vibrate while ink is being discharged, which may lead to instability in the movement of the carriage and deviation in the discharging position of the ink (i.e., a decline in recording quality).

As such, in recent years, a particular need has arisen for a liquid discharging apparatus provided with a carriage, capable of moving in the scanning direction and having a discharging portion capable of discharging a liquid, in which instability in the movement of the carriage can be prevented.

SUMMARY

An advantage of some aspects of the invention is that instability in the movement of the carriage, which is capable of moving in the scanning direction and having a discharging portion capable of discharging a liquid, is prevented.

Accordingly, a first aspect of the invention is a liquid discharging apparatus having a carriage that is capable of moving in a scanning direction and that has a discharging portion capable of discharging a liquid, a scale portion for confirming a position in the scanning direction of the carriage, and a cleaning portion that moves in the scanning direction of the carriage and is capable of cleaning the scale portion by contacting the scale portion. In such an apparatus, the cleaning portion is capable of displacement at a first state where contacting the scale portion and a second state where not contacting the scale portion.

A second aspect of the invention is the liquid discharging apparatus described in the first aspect, wherein the cleaning portion moves in the scanning direction in conjunction with the carriage.

A third aspect of the invention is the liquid discharging apparatus described in the second aspect, further having a sensor that moves in the scanning direction in conjunction with the carriage and reads a scale of the scale portion. Additionally, the cleaning portion includes a first cleaning portion positioned farther toward a first side in the scanning direction than the sensor and a second cleaning portion positioned farther towards a second side in the scanning direction than the sensor.

A fourth aspect of the invention is the liquid discharging apparatus described in the third aspect, wherein the first cleaning portion and the second cleaning portion are both set to the first state when cleaning the scale portion.

A fifth aspect of the invention is the liquid discharging apparatus described in the third aspect, wherein among the first cleaning portion and the second cleaning portion, when cleaning the scale portion, the cleaning portion positioned on a leading side in a movement direction of the carriage is set to the first state, and the cleaning portion positioned on a trailing side in the movement direction of the carriage is set to the second state.

A sixth aspect of the invention is the liquid discharging apparatus described in any one of the first to fifth aspects, wherein the cleaning portion is set to the second state when the carriage is not moving.

A seventh aspect of the invention is the liquid discharging apparatus described in any one of the first to sixth aspects, further having a supporting portion that is capable of moving in a movement direction intersecting the scanning direction and capable of supporting fabric as media. Additionally, in such an apparatus, the discharging portion is capable of discharging a liquid on the fabric supported by the supporting portion.

An eighth aspect of the invention is a method for cleaning a scale portion in a liquid discharging apparatus having a carriage that is capable of moving in a scanning direction and that has a discharging portion capable of discharging a liquid, and a scale portion for confirming a position in the scanning direction of the carriage. The method is executed by using a cleaning portion that is capable of cleaning the scale portion by moving in the scanning direction and by contacting the scale portion, and that is capable of displacement at a first state where contacting the scale portion and a second state where not contacting the scale portion.

Thus, an advantage of the invention is that instability in the movement of the carriage, which is capable of moving in the scanning direction and that has a discharging portion capable of discharging a liquid, can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus 1 will be described in detail as the liquid discharging apparatus according to an aspect of the invention while referring to the attached drawings.

Figure 1:
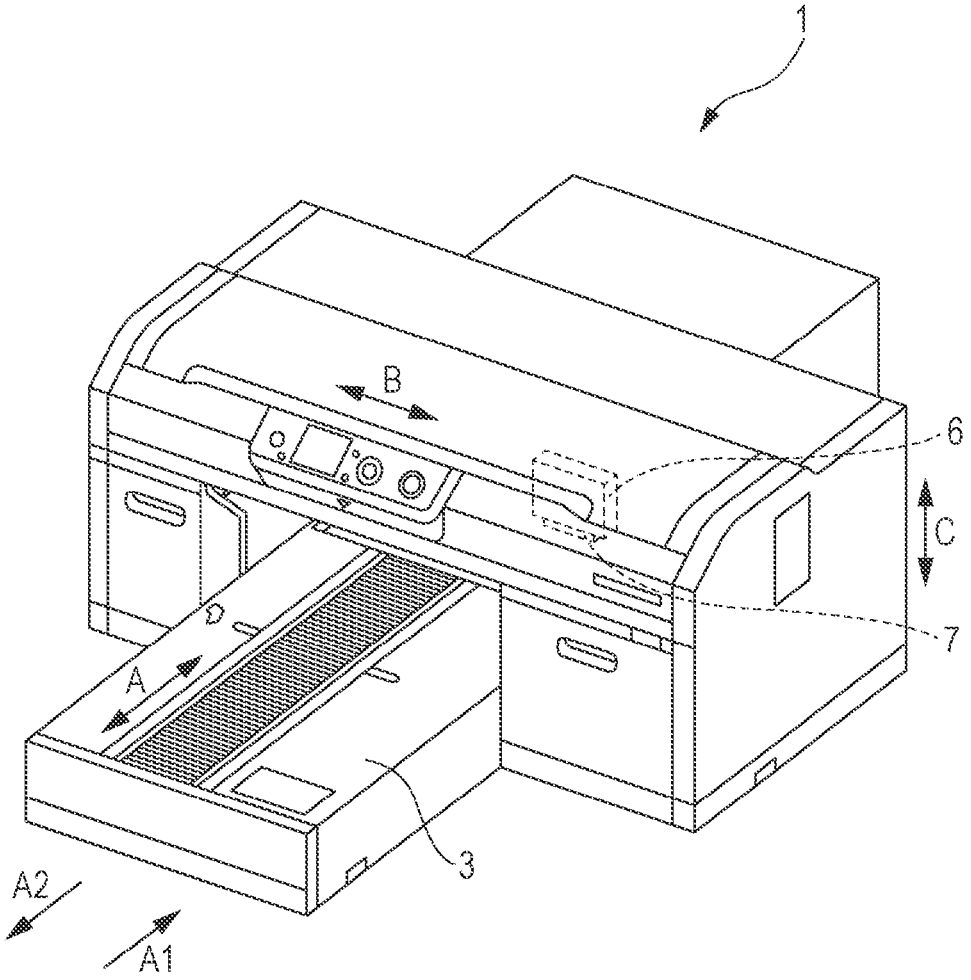
FIG. 1 is a schematic perspective view of a recording apparatus according to an aspect of the invention.
Figure 2:
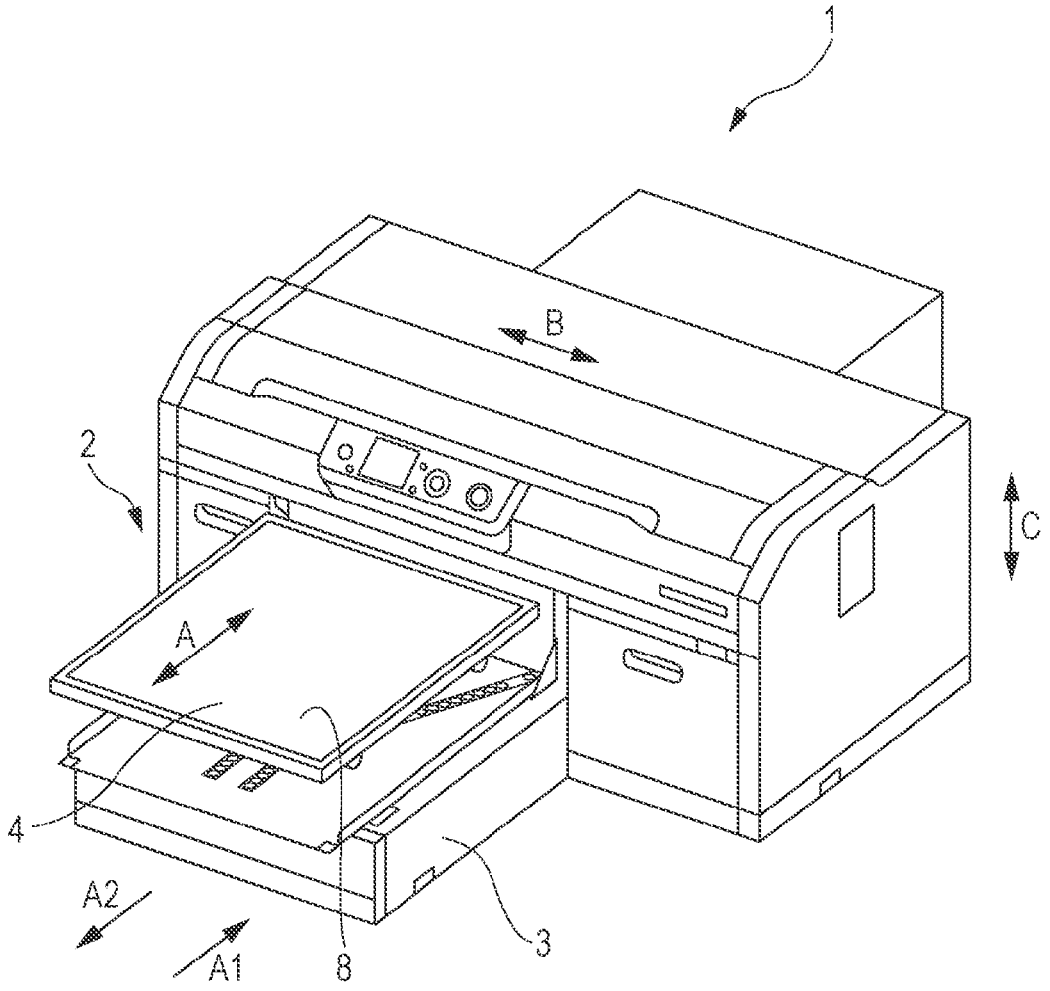
FIG. 2 is a schematic perspective view of a recording apparatus according to an aspect of the invention.

FIGS. 1 and 2 are schematic perspective views of the recording apparatus 1 according to an aspect of the invention. Specifically, FIG. 1 illustrates a state where a tray 4, as a supporting portion of media M in the recording apparatus 1 of the present embodiment, is at a recording start position; and FIG. 2 illustrates a state where the tray 4 is at a setting position of the media M.

Figure 3:
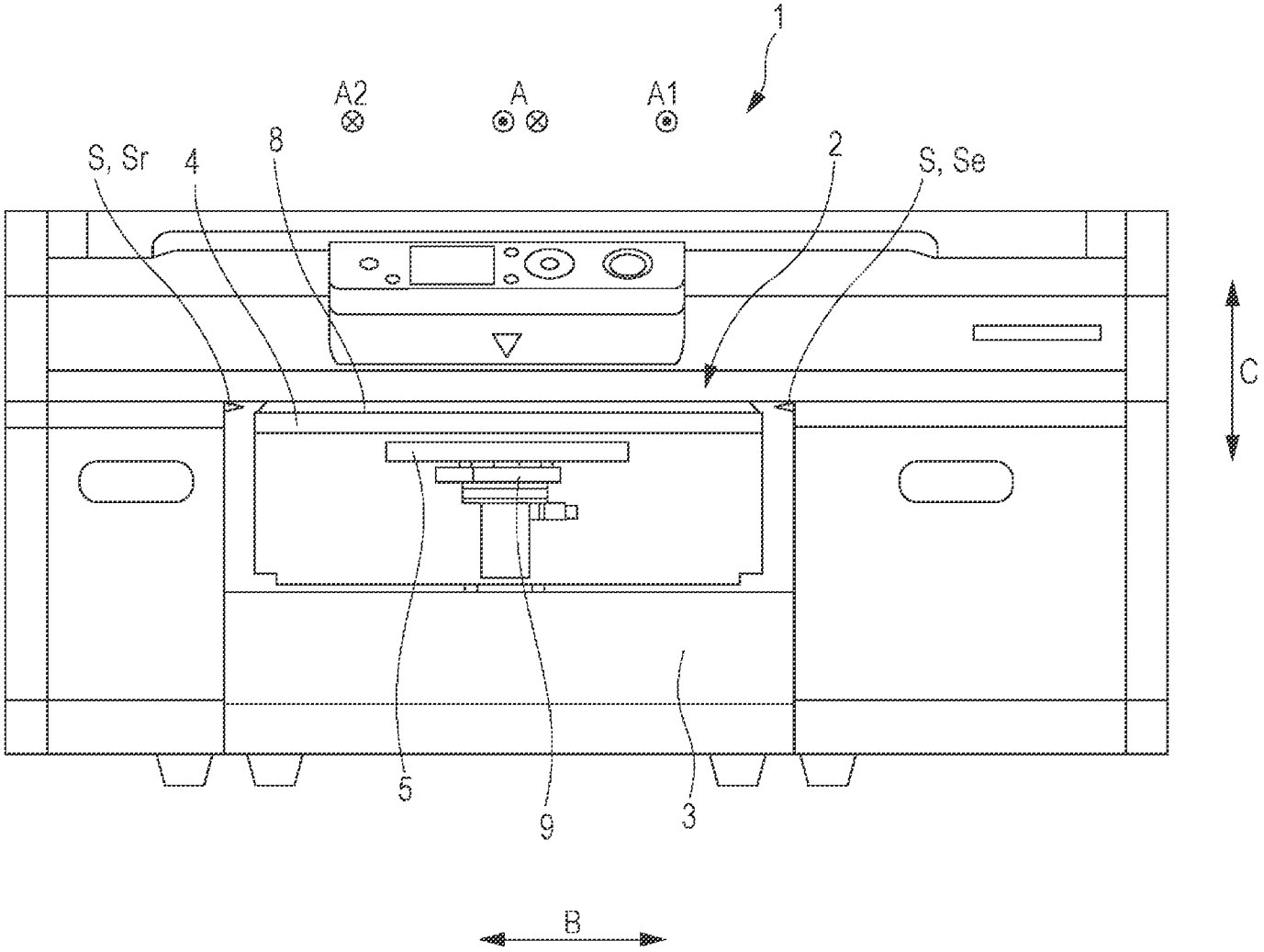
FIG. 3 is a schematic front view of a recording apparatus according to an aspect of the invention.

FIG. 3 is a schematic front view of the recording apparatus 1 of the present embodiment.

The recording apparatus 1 of the present embodiment is provided with a media supporting unit 2 that moves in movement directions A while supporting the media M on a supporting surface 8 of the tray 4. The media supporting unit 2 includes the tray 4, which is the supporting portion of the media M. The recording apparatus 1 is also provided with a media transporting unit 3 that transports the media M supported by the tray 4 in the movement directions A. The movement directions A include a direction A1, and a direction A2 opposite to the direction A1. Additionally, the tray 4 is mounted on a stage 5. The tray 4 is moved along with the stage 5 in a height direction C via rotation of a rotation lever 9. Note that various types of materials may be used as the media M including textiles (fabric, cloth, and the like), papers, polyvinyl chloride resins, and the like.

The interior of the main body of the recording apparatus 1 is provided with a recording head 7 as a discharging portion capable of discharging ink, as an example of a liquid, and recording on the media M. In the present embodiment, the recording head 7 corresponds to a recording unit capable of performing recording on the media M. The recording apparatus 1 of the present embodiment moves the carriage 6 provided with the recording head 7 in a reciprocating manner in scanning directions B orthogonal to the movement directions A and, thereby, forms a desired image by discharging ink from the recording head 7 onto the media M supported by the tray 4 while moving the recording head 7 in a reciprocating manner in the scanning directions B. The scanning directions B include a direction B1, and a direction B2 opposite to the direction B1.

In the recording apparatus 1 of the present embodiment, the near side (lower-left portion) in FIGS. 1 and 2 is the setting position (illustrated in FIG. 2) of the media M on the tray 4. After moving the tray 4, on which the media M is set, in the direction A1 among the movement directions A to the recording start position, that is, the far side (upper-right portion) in FIGS. 1 and 2, recording is performed while moving the tray 4 in the direction A2 among the movement directions A.

As illustrated in FIG. 3, the recording apparatus 1 of the present embodiment is also provided with a space sensor S. The space sensor S is configured so as to be able to detect the presence of anomalies (instances where the space between the media M and the recording head 7 is too narrow) in the space between the media M supported by the tray 4 and the recording head 7.

The space sensor S has a light emitter Se and a light receptor Sr. The space sensor S is configured to radiate light from the light emitter Se toward the light receptor Sr and detect the presence of anomalies in the space on the basis of whether or not the light is received by the light receptor Sr. However, the configuration of the space sensor S is not limited thereto.

Next, the electrical configuration of the recording apparatus 1 of the present embodiment will be described.

Figure 4:
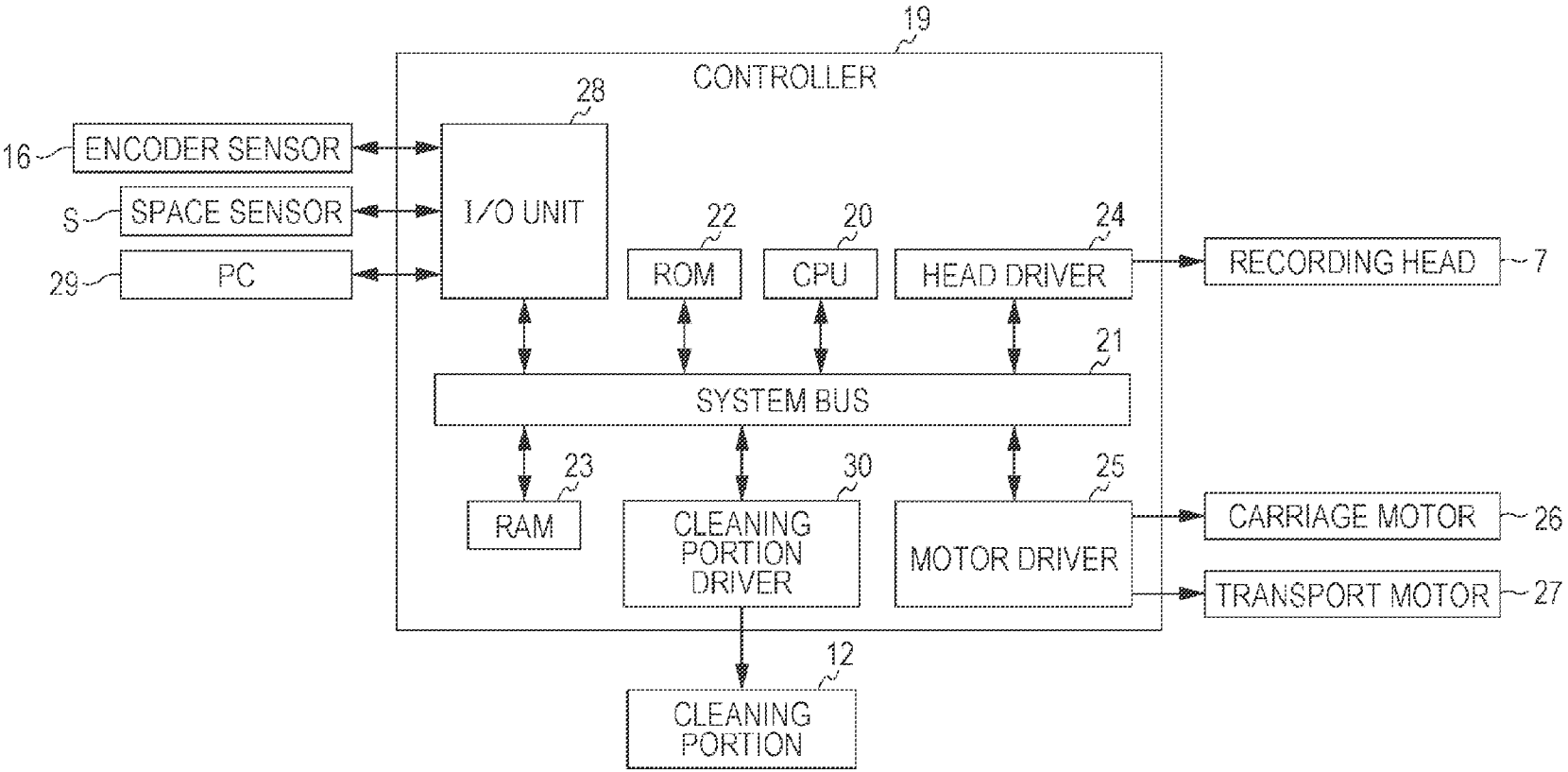
FIG. 4 is a block diagram of a recording apparatus according to an aspect of the invention.

FIG. 4 is a block diagram of the recording apparatus 1 of the present embodiment.

A controller 19 is provided with a CPU 20 that administrates control over the entire recording apparatus 1. The CPU 20 is connected via a system bus 21 to a ROM 22 in which various control programs and the like executed by the CPU 20 are stored, and a RAM 23 capable of temporarily storing data.

The CPU 20 is also connected via the system bus 21 to a head driver 24 for driving the recording head 7.

The CPU 20 is also connected via the system bus 21 to a motor driver 25. Moreover, the motor driver 25 is connected to a carriage motor 26 for moving the carriage 6 on which the recording head 7 is provided, and a transport motor 27 provided on the media transporting unit 3 for transporting the media M.

The CPU 20 is connected via the system bus 21 to a cleaning portion driver 30, which displaces a cleaning portion 12 (described hereinafter) so that the cleaning portion 12 is in a contact state or a non-contact state with the scale portion, namely the encoder scale 17 (see FIG. 6).

Furthermore, the CPU 20 is connected via the system bus 21 to an I/O unit 28; and the I/O unit 28 is connected to an encoder sensor 16 capable of reading a scale 31 of the encoder scale 17 (see FIG. 7), the space sensor S, and a PC 29 for performing sending and receiving of data such as recording data, signals, and the like.

Next, the media supporting unit 2 of the present embodiment will be described in detail.

Figure 5:
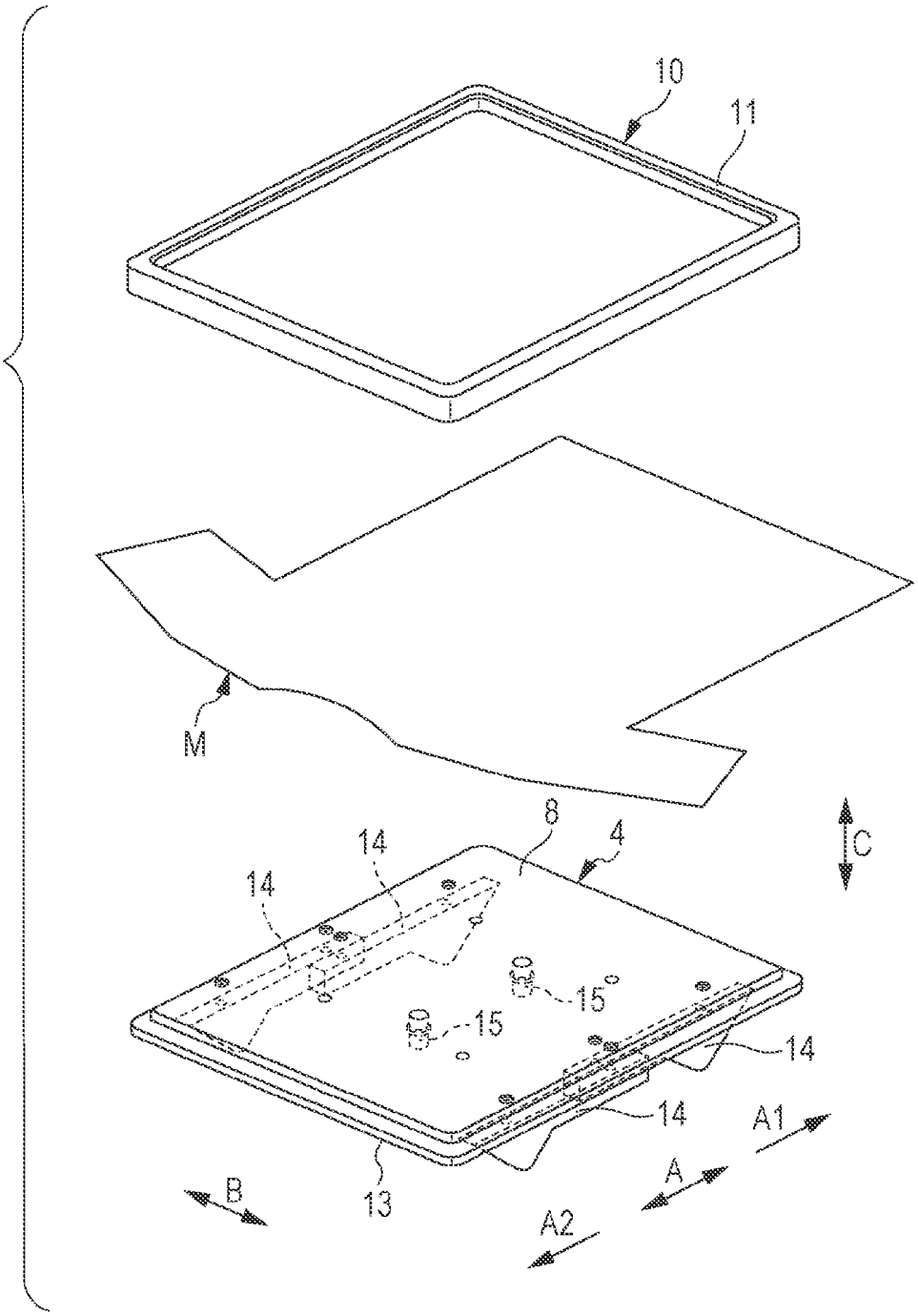
FIG. 5 is a schematic perspective view illustrating a media supporting unit of a recording apparatus according to an aspect of the invention.

FIG. 5 is a schematic perspective view illustrating the media supporting unit 2 of the present embodiment.

As illustrated in FIG. 2, the media supporting unit 2 of the present embodiment is provided with the tray 4 as a supporting portion capable of supporting the media M, and a frame-shape hold-down portion 10 capable of holding down the media M supported on the tray 4.

The media supporting unit 2 is configured to enable the media M to be held down by the hold-down portion 10. In this configuration, the media M is supported on the supporting surface 8 of the tray 4 and an eave portion 11 of the hold-down portion 10 is mounted on an edge portion 13 of the tray 4.

Additionally, the tray 4 of the present embodiment is provided with a setting unit 14 for cases where the tray 4 is removed from the stage 5 and set on the floor or the like, and a positioning portion 15 capable of positioning the tray on the stage 5.

However, the configurations of the hold-down portion 10 and the tray 4 are not particularly limited to the description given above.

Next, the carriage 6 of the present embodiment will be described in detail.

Figure 6:
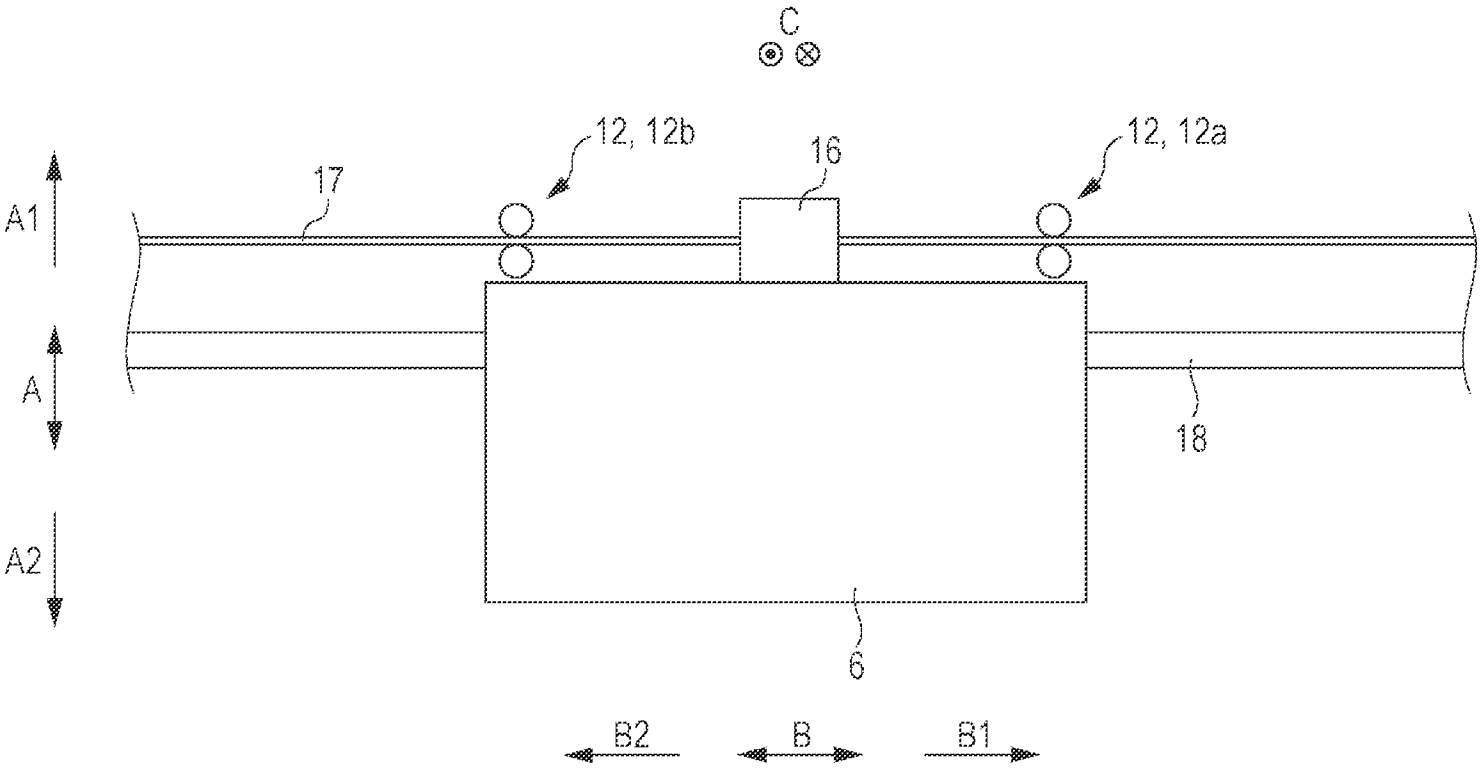
FIG. 6 is a schematic plan view illustrating the carriage of a recording apparatus according to an aspect of the invention.

FIG. 6 is a schematic perspective view illustrating the carriage 6 of the present embodiment.

Figure 7:
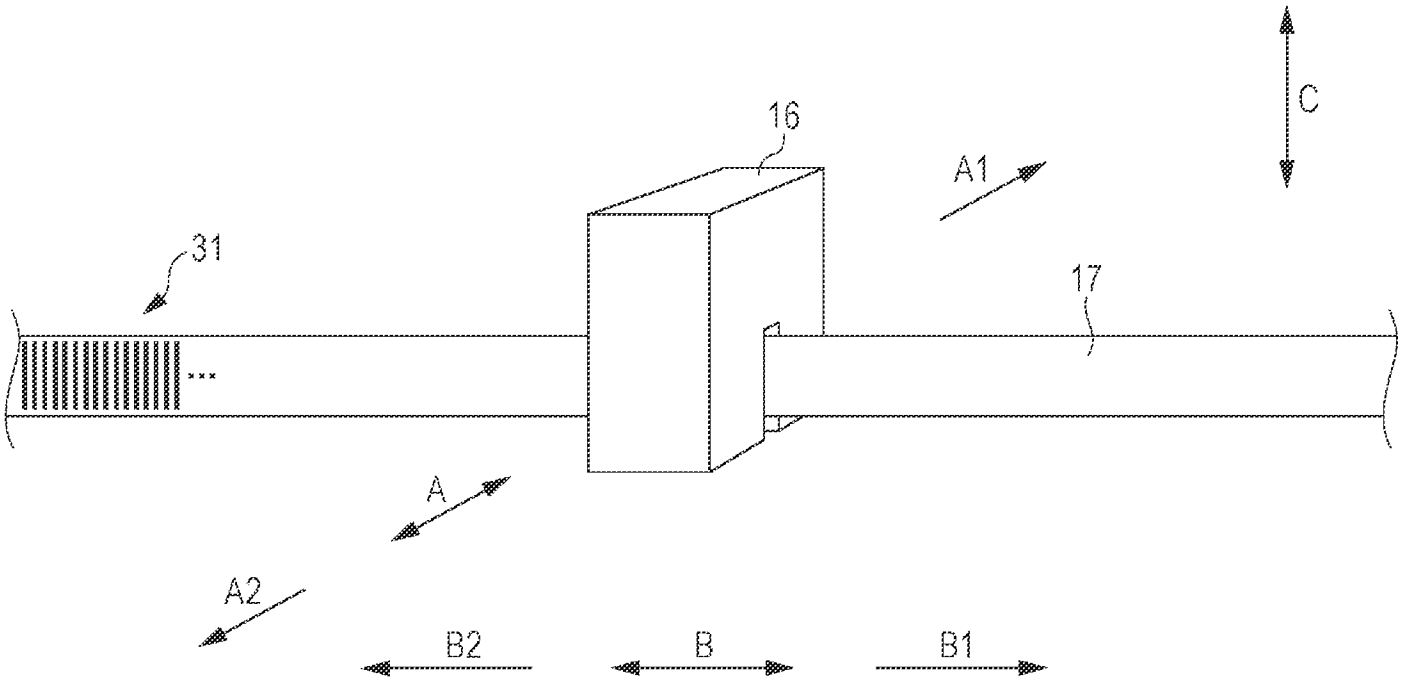
FIG. 7 is a schematic perspective view illustrating an encoder sensor of a recording apparatus according to an aspect of the invention.

FIG. 7 is a schematic perspective drawing, viewed from the front, illustrating the encoder sensor 16 and an encoder scale 17 provided in the carriage 6 of the present embodiment.

Figure 8A:
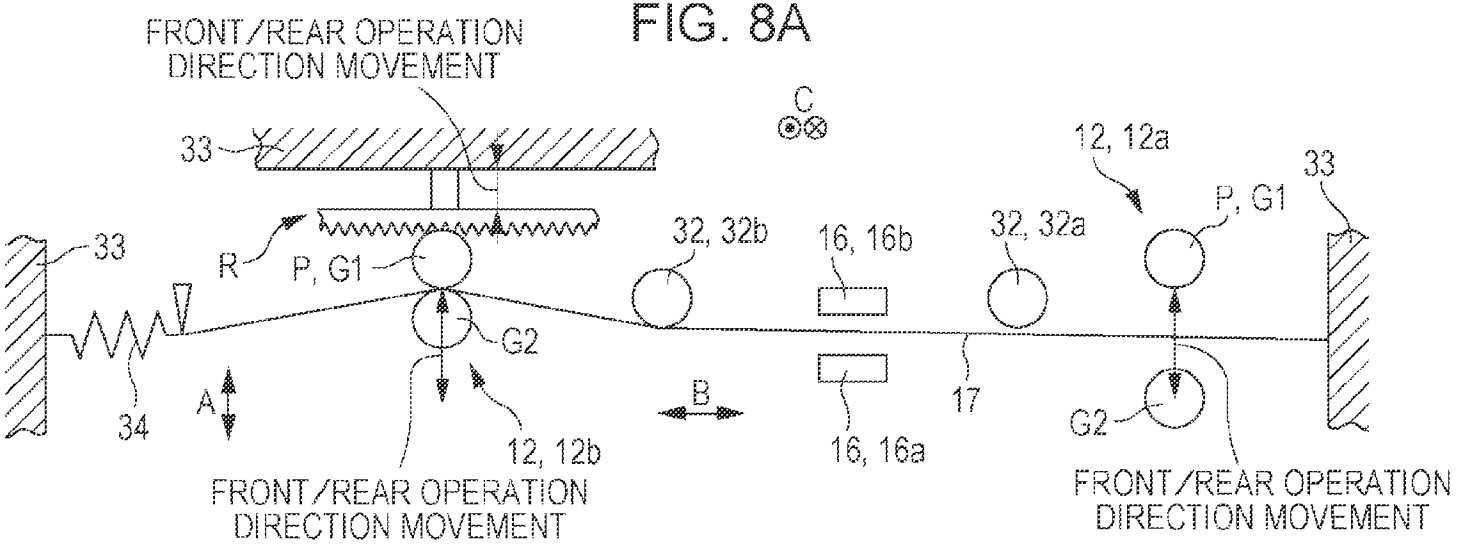
FIGS. 8A to 8C are schematic plan views illustrating the main constituents of a recording apparatus according to an aspect of the invention.
Figure 8C:
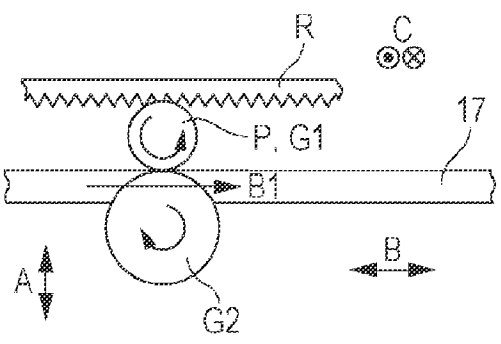
Figure 8B:
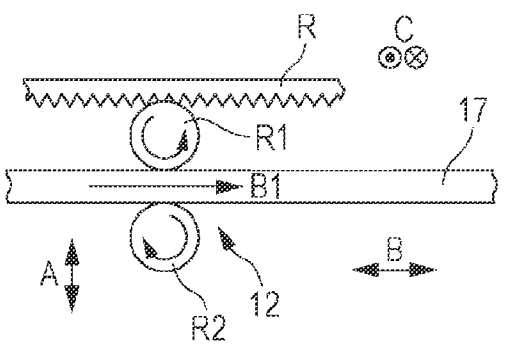

FIGS. 8A to 8C are schematic drawings illustrating the main constituents of the recording apparatus 1 of the present embodiment. FIG. 8A illustrates the positional relationships of the carriage 6, the encoder sensor 16, the encoder scale 17, the cleaning portion 12 of the encoder scale 17, and the like. FIG. 8B illustrates the positional relationship of the cleaning portion 12 with respect to the encoder scale 17 at a time of cleaning of the encoder scale 17. FIG. 8C illustrates the positional relationship of a driver (rack R and pinion P) of the cleaning portion 12 at a time of cleaning of the encoder scale 17.

The carriage 6 of the present embodiment is capable of reciprocating movement in the scanning directions B along a guide shaft 18 extending in the scanning directions B due to the driving force of a carriage motor 26. Moreover, the encoder scale 17 is provided along the guide shaft 18 on the back side of the carriage 6 in the recording apparatus 1 of the present embodiment. Additionally, the encoder sensor 16 capable of reading the scale 31 of the encoder scale 17, and the cleaning portion 12 capable of cleaning the encoder scale 17 by contacting the encoder scale 17 are provided on the back side of the carriage 6 of the present embodiment.

As described previously, the recording apparatus 1 of the present embodiment is provided with the carriage 6 that is capable of moving in the scanning directions B and that has the recording head 7 capable of discharging ink, the encoder scale 17 for confirming the position in the scanning directions B of the carriage 6, and the cleaning portion 12 that moves in the scanning directions B in conjunction with the carriage 6 and is capable of cleaning the encoder scale 17 by contacting the encoder scale 17.

As illustrated in FIG. 8A, the cleaning portion 12 is capable of displacement at a first state where contacting the encoder scale 17 (cleaning portion 12*b* in FIG. 8A) and a second state where not contacting the encoder scale 17 (cleaning portion 12*a* in FIG. 8A).

As a result of this configuration, the recording apparatus 1 of the present embodiment can clean the encoder scale 17 by setting the cleaning portion 12 to the first state when cleaning the encoder scale 17. Additionally, instability in the movement of the carriage 6 can be prevented by setting the cleaning portion 12 to the second state when there is a need to prevent instability in the movement of the carriage 6 such as while ink is being discharged. Due to the fact that the cleaning portion 12 is capable of displacement at the first state and the second state, constant contact of the cleaning portion 12 with the encoder scale 17 can be avoided. Therefore, the movement load on the carriage 6 can be reduced and wear of both the cleaning portion 12 and the encoder scale 17 caused by friction occurring as a result of contact between the cleaning portion 12 and the encoder scale 17 can be prevented.

Additionally, the recording apparatus 1 of the present embodiment has a configuration in which displacement of the cleaning portion 12 to the first state and the second state can be performed automatically through control by the controller 19. However, a configuration in which a user manually displaces the cleaning portion 12 to the first state and the second state is also possible. Moreover, while the recording apparatus 1 of the present embodiment has a configuration in which the cleaning portion 12 is provided in the carriage 6 and is capable of moving in the scanning directions B in conjunction with the carriage 6, the configuration is not limited thereto and the cleaning portion 12 and the carriage 6 may be configured as separate constituents. However, the configuration in which the cleaning portion 12 is provided in the carriage 6 and is capable of moving in the scanning directions B in conjunction with the carriage 6 is preferable as there is no need for an additional movement mechanism for the cleaning portion 12.

To rephrase the previous description, the encoder scale 17 can be cleaned using the cleaning portion 12 of the present embodiment, which is capable of cleaning the encoder scale 17 by moving in the scanning directions B in conjunction with the carriage 6 and contacting the encoder scale 17, and is capable of displacement at the first state where contacting the encoder scale 17 and the second state where not contacting the encoder scale 17.

Through this method of cleaning the encoder scale 17, the encoder scale 17 can be cleaned by setting the cleaning portion 12 to the first state when cleaning the encoder scale 17 and, instability in the movement of the carriage 6 can be prevented by setting the cleaning portion 12 to the second state when there is a need to prevent instability in the movement of the carriage 6 such as while ink is being discharged.

As illustrated in FIGS. 6 and 8A, the recording apparatus 1 of the present embodiment is provided with the encoder sensor 16 that moves in the scanning directions B in conjunction with the carriage 6 and functions as a sensor that reads the scale 31 of the encoder scale 17. Moreover, the cleaning portion 12 has a first cleaning portion 12*a* positioned farther toward a first side in the scanning directions B than the encoder sensor 16 and a second cleaning portion 12*b* positioned farther towards a second side in the scanning directions B than the encoder sensor 16.

Due to the fact that the cleaning portion 12 is provided on both sides in the scanning directions B of the encoder sensor 16, high cleaning performance can be obtained, namely the cleaning area is widened, cleaning ability is improved, and the like. Note that "cleaning ability" refers to the ability to remove debris and the like from a predetermined area. Additionally, "cleaning performance" refers to general performance including the cleaning area (size of cleanable area), cleaning ability, and the like.

According to the recording apparatus 1 of the present embodiment, the space in the scanning directions B between the encoder sensor 16 and the first cleaning portion 12*a* and the space in the scanning directions B between the encoder sensor 16 and the second cleaning portion 12*b* are roughly equivalent. Herein, the meaning of "roughly equivalent" shall be construed to include cases where perfectly equal to each other and cases where slight inequalities occur due to manufacturing tolerances. Thereby, variation in the cleaning performance of the first cleaning portion 12*a* and the cleaning performance of the second cleaning portion 12*b* can be reduced.

Additionally, the first cleaning portion 12*a* and the second cleaning portion 12*b* are disposed in the vicinity of both edges of the carriage 6 in the scanning directions B. Thereby, debris such as ink mist and the like can be prevented from adhering in the vicinity of the encoder sensor 16.

In the recording apparatus 1 of the present embodiment, the controller 19 can control the driving of the cleaning portion 12 via two methods when cleaning the encoder scale 17.

In the first method, the controller 19 can control the driving of the cleaning portion 12 such that the first cleaning portion 12*a* and the second cleaning portion 12*b* are both set to the first state when cleaning the encoder scale 17. That is, the cleaning portions 12 on both sides of the encoder sensor 16 are both made to contact the encoder scale 17 when cleaning the encoder scale 17. As a result, the cleaning area becomes wider, the cleaning ability is improved and high cleaning performance can be obtained.

In the second method, the controller 19 can control the driving of the cleaning portion 12 such that, among the first cleaning portion 12*a* and the second cleaning portion 12*b*, when cleaning the encoder scale 17, the cleaning portion 12 positioned on a leading side in the movement direction of the carriage 6 is set to the first state, and the cleaning portion 12 positioned on a trailing side in the movement direction of the carriage 6 is set to the second state. For example, when moving in the direction B1 among the scanning directions B, the first cleaning portion 12*a* is on the leading side and set to the first state, and the second cleaning portion 12*b* is on the trailing side and set to the second state. Moreover, when moving in the direction B2 among the scanning directions B, the second cleaning portion 12*b* is on the leading side and set to the first state, and the first cleaning portion 12*a* is on the trailing side and set to the second state. When cleaning the encoder scale 17, carry-along of foreign particles toward the encoder sensor 16 and movement load on the carriage 6 can be reduced by controlling the driving of the cleaning portion 12 as described above.

Next, specific movement of the cleaning portion 12 at the first state and the second state in the recording apparatus 1 of the present embodiment will be described.

As illustrated in FIGS. 8A to 8C, the cleaning portion 12 of the present embodiment is configured from a pair of rollers (rollers R1 and R2) that have rotational axes in common with gears G1 and G2. The roller R2 is configured to be capable of moving in a front/rear operation direction along the movement directions A (see FIG. 8A) with respect to the roller R1. Specifically, the roller R2 is capable of moving in directions toward and away from the roller R1 via electrical control by the controller 19 and in more detail, while not illustrated in the drawings, by a cleaning portion driver 30 including an actuator and the like. Moreover, the state where the roller R2 is close to the roller R1 (the state of the cleaning portion 12*b* in FIG. 8A) is the first state, and the state where the roller R2 is separated from the roller R1 (the state of the cleaning portion 12*a* in FIG. 8A) is the second state.

Additionally, the main body portion 33 of the recording apparatus 1 of the present embodiment is provided with a rack R capable of moving in directions toward and away from the gear G1 (the front/rear operation direction) via electrical control by the controller 19, and the gear G1 also functions as a pinion P that interlocks with the rack R. FIGS. 8B and 8C illustrate states of the carriage 6 being moved in the direction B1. As illustrated in FIG. 8C, the gear G1 and the gear G2 interlock when the encoder scale 17 is being cleaned by the cleaning portion 12. As a result, as illustrated in FIG. 8B, due to the rack R being moved to a position at which it interlocks with the pinion P, when the encoder scale 17 is being cleaned by the cleaning portion 12, the rollers R1 and R2 can be rotated along with the movement of the carriage 6. At this time, due to the fact that the pinion P (the gear G1) and the rack R are interlocked, the roller R1 and the roller R2 rotate in the direction opposite to the movement of the carriage 6 in the direction B1. As a result of this configuration in which the rollers R1 and R2 rotate, due to the movement of the carriage 6, in a direction opposite to the movement of the carriage 6, the cleaning efficiency of the recording apparatus 1 of the present embodiment when cleaning the encoder scale 17 can be improved. Additionally, with the recording apparatus 1 of the present embodiment, it is possible to cause the cleaning portion 12 to clean the encoder scale 17 without moving the rack R to the position at which it interlocks with the pinion P. In this case, the roller R1 and the roller R2 rotate in the direction following the movement of the carriage 6 in the direction B1. This is because the roller R1 and the roller R2, which have rotational axes, rotate when driven. In this case, the movement load on the carriage 6 can be particularly reduced. Additionally, in cases where the rack R is not moved to the position at which it interlocks with the pinion P, the rotational axes of the roller R1 and the roller R2 may be locked and the cleaning portion 12 may be made to clean the encoder scale 17 without rotating the roller R1 and the roller R2. With this configuration cleaning ability can be improved compared with cases where the rotational axes of the roller R1 and the roller R2 are not locked.

Note that the invention is not particularly limited to the configuration where the roller R2 moves in the front/back operation direction with respect to the roller R1 (cleaning portion driver 30) or the configuration where the rack R is moves in the front/back operation direction with respect to the gear G as the pinion P. For example, a solenoid in which a wire is wound loosely in a helical manner into a cylindrical shaped coil can be used.

As described previously, the cleaning portion 12 of the present embodiment is configured so that the roller R2 is capable of moving in directions toward and away from the roller R1. As such, the encoder scale 17 deflects when being cleaned by the cleaning portion 12. In order to prevent the encoder scale 17 from contacting the encoder sensor 16 as a result of this deflection, a spring 34 for imparting tension to the encoder scale 17 is provided at an end portion of a first side of the encoder scale 17, and a contact preventing portion 32 (guide rollers 32*a* and 32*b*) is also provided. In the carriage of the present embodiment, the guide rollers 32*a* and 32*b* are provided as the contact preventing portion 32 for preventing contact with the light receptor 16*b* side of the encoder sensor 16. However, a contact preventing portion for preventing contact with the light emitter 16*a* side of the encoder sensor 16 may be provided.

Additionally, while the cleaning portion 12 of the present embodiment is configured so that the roller R1 is capable of moving in directions toward and away from the roller R1, the cleaning portion 12 is not limited to this configuration. For example, a configuration is possible in which both of the roller R1 and the roller R2 are capable of moving in directions toward and away from each other. With such a configuration, deflections in the encoder scale 17 can be prevented.

In the recording apparatus 1 of the present embodiment, the controller 19 can set both the cleaning portions 12 to the second state when the carriage 6 is not moving. By controlling the driving of the cleaning portion 12 in this manner, wear on both the cleaning portion 12 and the encoder scale 17 can be prevented as a result of the cleaning portion 12 not contacting the encoder scale 17 when there is no need for contact with the encoder scale 17 such as when not cleaning the encoder scale 17.

The cleaning portion 12 may have a configuration in which a cam mechanism is capable of displacing the cleaning portion 12 at the first state and the second state. In such a configuration, the cleaning portion 12 can be displaced at the first state and the second state via a simple configuration, namely a cam mechanism.

Fabric, such as the t-shirt illustrated in FIG. 5 or the like can be used as the media M in the recording apparatus 1 of the present embodiment. That is, the recording apparatus 1 of the present embodiment has a configuration in which the tray 4 is capable of moving in the movement directions A intersecting the scanning directions B and is capable of supporting fabric as the media M; and the recording head 7 is capable of discharging ink onto the fabric supported by the tray 4. With the recording apparatus 1 configured thusly, the encoder scale 17 is particularly prone to becoming soiled with ink mist. However, as described previously, even in cases where the encoder scale 17 is soiled, the recording apparatus 1 of the present embodiment can clean the encoder scale 17 while preventing instability in the movement of the carriage 6.

The embodiment described above is for the purpose of elucidating the invention and is not to be construed as limiting the invention. The invention can of course be altered and improved without departing from the gist thereof and includes equivalents. Such implementations are, of course, also included in the invention. For example, the recording apparatus 1 of the present embodiment is a liquid discharging apparatus having a configuration provided with the tray 4, which is capable of moving in the movement directions A intersecting the scanning directions B and is capable of supporting fabric as the media M. However, the recording apparatus 1 of the present embodiment may be a liquid discharging apparatus having a configuration in which the media M is transported by a pair of rollers, a transport belt, or the like; or may be a flatbed type liquid discharging apparatus in which the supporting portion of the media M does not move and only the carriage 6 moves.

Thus concludes the description of the invention based on a specific embodiment. Hereinafter, the invention is summed up.

The first aspect of the invention is a liquid discharging apparatus 1 having a carriage 6 that is capable of moving in scanning directions B and that has a discharging portion 7 capable of discharging a liquid, a scale portion 17 for confirming the position in the scanning directions B of the carriage 6, and a cleaning portion 12 that moves in the scanning directions B of the carriage 6 and is capable of cleaning the scale portion 17 by contacting the scale portion 17. In such an apparatus, the cleaning portion 12 is capable of displacement at a first state where contacting the scale portion 17 and a second state where not contacting the scale portion 17.

According to the first aspect, the cleaning portion 12 capable of cleaning the scale portion 17 by contacting the scale portion 17 is provided; and the cleaning portion 12 is capable of displacement at the first state where contacting the scale portion 17 and the second state where not contacting the scale portion 17. Specifically, the scale portion 17 can be cleaned by setting the cleaning portion 12 to the first state when cleaning the encoder scale 17 and, instability in the movement of the carriage 6 can be prevented by setting the cleaning portion 12 to the second state when there is a need to prevent instability in the movement of the carriage 6 such as while ink is being discharged. Due to the fact that the cleaning portion 12 is capable of displacement at the first state and the second state, constant contact of the cleaning portion 12 with the encoder scale 17 can be avoided. Therefore, the movement load on the carriage 6 can be reduced and wear of both the cleaning portion 12 and the scale portion 17 caused by friction occurring as a result of contact between the cleaning portion 12 and the encoder portion 17 can be prevented.

Herein the meaning of "capable of displacement" shall be construed to include configurations in which displacing at the first state and the second state can be performed automatically via controlling by the controller 19 or the like, and configurations in which a user manually displaces the cleaning portion 12 to the first state and the second state.

The second aspect of the invention is the liquid discharging apparatus 1 described in the first aspect, wherein the cleaning portion 12 moves in the scanning directions B in conjunction with the carriage 6.

According to the second aspect, the cleaning portion 12 moves in the scanning directions B in conjunction with the carriage 6. Thus, for example, by adopting a configuration in which the cleaning portion 12 is provided in the carriage 6 and is capable of moving in the scanning directions B in conjunction with the carriage 6, the need for an additional movement mechanism for the cleaning portion 12 can be eliminated.

The third aspect of the invention is the liquid discharging apparatus 1 described in the second aspect, further having a sensor 16 that moves in the scanning directions B in conjunction with the carriage 6 and reads a scale 31 of the scale portion 17. Additionally, the cleaning portion 12 is provided with a first cleaning portion 12*a* positioned farther toward a first side in the scanning directions B than the sensor 16 and a second cleaning portion 12*b* positioned farther towards a second side in the scanning directions B than the sensor 16.

According to the third aspect, the cleaning portion 12 has the first cleaning portion 12*a* positioned farther toward a first side in the scanning directions B than the sensor 16 and the second cleaning portion 12*b* positioned farther towards a second side in the scanning directions B than the sensor 16. That is, the cleaning portion 12 is provided on both sides of the sensor 16. As such, high cleaning performance can be obtained, namely the cleaning area is widened, cleaning ability is improved, and the like.

The fourth aspect of the invention is the liquid discharging apparatus 1 described in the third aspect, wherein the first cleaning portion 12*a* and the second cleaning portion 12*b* of the third aspect are both set to the first state when cleaning the scale portion 17.

According to the fourth aspect, the first cleaning portion 12*a* and the second cleaning portion 12*b* of the third aspect are both set to the first state when cleaning the scale portion 17. That is, the cleaning portions 12 on both sides of the sensor 16 are both made to contact the scale portion 17 when cleaning the scale portion 17. As such, the cleaning area is wider, the cleaning ability is improved and high cleaning performance can be obtained.

The fifth aspect of the invention is the liquid discharging apparatus 1 described in the third aspect, wherein of the first cleaning portion 12*a* and the second cleaning portion 12*b*, when cleaning the scale portion 17, the cleaning portion 12 positioned on a leading side in a movement direction of the carriage 6 is set to the first state, and the cleaning portion 12 positioned on a trailing side in the movement direction of the carriage 6 is set to the second state.

According to the fifth aspect, of the first cleaning portion 12*a* and the second cleaning portion 12*b*, when cleaning the encoder scale 17, the cleaning portion 12 positioned on the leading side in the movement direction of the carriage 6 is set to the first state, and the cleaning portion 12 positioned on the trailing side in the movement direction of the carriage 6 is set to the second state. As such, carry-along of foreign particles toward the sensor 16 and movement load on the carriage 6 can be reduced due to the cleaning portion 12 positioned on the trailing side in the movement direction of the carriage 6 not contacting the scale portion 17 while the cleaning portion 12 positioned on the leading side in the movement direction of the carriage 6 cleans the scale portion 17.

The sixth aspect of the invention is the liquid discharging apparatus 1 described in any one of the first to fifth aspects, wherein the cleaning portion 12 is set to the second state when the carriage 6 is not moving.

According to the sixth aspect, the cleaning portions 12 are set to the second state when the carriage 6 is not moving. Thus, wear on both the cleaning portion 12 and the encoder scale 17 can be prevented as a result of the cleaning portion 12 not contacting the encoder scale 17 when there is no need for contact with the encoder scale 17 such as when not cleaning the encoder scale 17.

The seventh aspect of the invention is the liquid discharging apparatus 1 described in any one of the first to sixth aspects, further having a supporting portion 4 that is capable of moving in movement directions A intersecting the scanning directions B and capable of supporting fabric as the media M. Additionally, in such an apparatus, the discharging portion 7 is capable of discharging a liquid on the fabric supported by the supporting portion 4.

According to the seventh aspect, the supporting portion 4 is provided that is capable of moving in the movement directions A intersecting the scanning directions B and capable of supporting fabric as the media M; and the discharging portion 7 is capable of discharging a liquid on the fabric supported by the supporting portion 4. That is, the liquid discharging apparatus 1 is provided with the supporting portion 4 capable of moving in the movement directions A intersecting the scanning directions B; and fabric can be used as the media M. With the recording apparatus 1 configured thusly, the scale portion 17 is particularly prone to becoming soiled with ink mist. However, even in cases where the scale portion 17 is soiled, the recording apparatus 1 of the present embodiment can clean the scale portion 17 while preventing instability in the movement of the carriage 6.

The eighth aspect of the invention is a method for cleaning a scale portion 17 in the liquid discharging apparatus 1 having a carriage 6 that is capable of moving in the scanning directions B and that has the discharging portion 7 capable of discharging a liquid, and a scale portion 17 for confirming the position in the scanning directions B of the carriage 6. The method is executed using the cleaning portion 12 that is capable of cleaning the scale portion 17 by contacting the scale portion 17, and capable of displacement at a first state where contacting the scale portion 17 and a second state where not contacting the scale portion 17.

According to the eighth aspect, the method for cleaning the scale portion 17 is executed using the cleaning portion 12 that is capable of cleaning the scale portion 17 by contacting the scale portion 17, and capable of displacement at the first state where contacting the scale portion 17 and the second state where not contacting the scale portion 17. Specifically, the scale portion 17 can be cleaned by setting the cleaning portion 12 to the first state when cleaning the encoder scale 17 and, instability in the movement of the carriage 6 can be prevented by setting the cleaning portion 12 to the second state when there is a need to prevent instability in the movement of the carriage 6 such as while ink is being discharged.

This application claims priority under 35 U.S.C. §119 to Japanese Patent Application No. 2015-122640, filed Jun. 18, 2015. The entire disclosure of Japanese Patent Application No. 2015-122640 is hereby incorporated herein by reference.

What is claimed is:

1. A liquid discharging apparatus comprising:

a carriage that is capable of moving in a scanning direction and that has a discharging portion capable of discharging a liquid, a scale portion for confirming a position in the scanning direction of the carriage, and a cleaning portion that moves in the scanning direction of the carriage and is capable of cleaning the scale portion by contacting the scale portion, wherein the cleaning portion configured to be displaced at a first state where contacting the scale portion and a second state where not contacting the scale portion, wherein the cleaning portion includes a first cleaning portion and a second cleaning portion, and when cleaning the scale portion, among the first cleaning portion and the second cleaning portion, the cleaning portion positioned on a leading side in a movement direction of the carriage is set to the first state, and the cleaning portion positioned on a trailing side in the movement direction of the carriage is set to the second state.

2. The liquid discharging apparatus according to claim 1, wherein the cleaning portion moves in the scanning direction in conjunction with the carriage.

3. The liquid discharging apparatus according to claim 2, further comprising:

a sensor that moves in the scanning direction in conjunction with the carriage, and reads a scale of the scale portion, wherein the first cleaning portion is positioned farther toward a first side in the scanning direction than the sensor and the second cleaning portion is positioned farther towards a second side in the scanning direction than the sensor.

4. The liquid discharging apparatus according to claim 3, wherein the first cleaning portion and the second cleaning portion are both set to the first state when cleaning the scale portion.

5. The liquid discharging apparatus according to claim 1, wherein the cleaning portion is set to the second state when the carriage is not moving.

6. The liquid discharging apparatus according to claim 1, further comprising:

a supporting portion that is capable of moving in a movement direction intersecting the scanning direction and capable of supporting fabric as media, wherein the discharging portion is capable of discharging a liquid on the fabric supported by the supporting portion.

7. A method for cleaning a scale portion in a liquid discharging apparatus having a carriage configured to move in a scanning direction and that has a discharging portion configured to discharge a liquid, and a scale portion for confirming a position in the scanning direction of the carriage, the method comprising executing the cleaning by using first and second cleaning portions that clean the scale portion by moving in the scanning direction and by contacting the scale portion, the cleaning being further executed with one of the first and second cleaning portions being displaced at a first state contacting the scale portion and the other of the first and second cleaning portions being at a second state not contacting the scale portion, wherein, when cleaning the scale portion, among the first cleaning portion and the second cleaning portion, the cleaning portion positioned on a leading side in a movement direction of the carriage is set to the first state, and the cleaning portion positioned on a trailing side in the movement direction of the carriage is set to the second state.

* * * * *